US007277058B2

(12) United States Patent
Faraone et al.

(10) Patent No.: US 7,277,058 B2
(45) Date of Patent: Oct. 2, 2007

(54) WIRELESS COMMUNICATION DEVICE ANTENNA FOR IMPROVED COMMUNICATION WITH A SATELLITE

(75) Inventors: Antonio Faraone, Plantation, FL (US); Giorgi G. Bit-Babik, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/027,308

(22) Filed: Dec. 30, 2004

(65) Prior Publication Data

US 2006/0145930 A1 Jul. 6, 2006

(51) Int. Cl.
*H01Q 1/24* (2006.01)

(52) U.S. Cl. ..... 343/702; 343/815

(58) Field of Classification Search ..... 343/702, 343/700 MS, 815, 833, 834
See application file for complete search history.

(56) References Cited

U.S. PATENT DOCUMENTS

| | | | | |
|---|---|---|---|---|
| 6,028,567 | A * | 2/2000 | Lahti | 343/895 |
| 6,100,848 | A * | 8/2000 | Hayes | 343/702 |
| 6,229,489 | B1 * | 5/2001 | Holshouser et al. | 343/702 |
| 7,023,388 | B2 * | 4/2006 | Shimabara | 343/702 |
| 2005/0057407 | A1 * | 3/2005 | Imaizumi et al. | 343/702 |

* cited by examiner

*Primary Examiner*—Tho Phan

(57) ABSTRACT

A wireless communication device includes a mobile wireless communication signal creation and reception circuit (310) coupled to a resonator (320) capable of sending and/or receiving wireless communication signals. A parasitic element (340) is coupled to the resonator (320) in an approximately orthogonal arrangement such that the parasitic element (340) and the resonator (320) resonate together to send and/or receive a wireless communication signal. Preferably, the parasitic element (340) and resonator (320) are contained within a housing (520) of a wireless communication device handset (500) to provide improved communications with a satellite (700).

15 Claims, 3 Drawing Sheets

WIRELESS COMMUNICATION DEVICE ANTENNA FOR IMPROVED COMMUNICATION WITH A SATELLITE

TECHNICAL FIELD

This invention relates generally to antennas and more particularly to antennas for communications between a wireless communication handset and a satellite.

BACKGROUND

Wireless communication devices of various kinds are known in the art. Such devices necessarily employ resonators, antennas, or other means of sending and receiving signals. The design for a particular antenna will vary depending on the size and signal constraints for the wireless communication device or system.

Size and signal constraints are of particular importance in wireless communication device handsets such as mobile stations or mobile phones. As the use of such mobile units becomes more widespread, wireless communication system operators add more features to the units to increase their marketability and usefulness to users. As part of the increased scope of features, system operators now offer features that require communication between the wireless communication device and one or more satellites. An example of such a feature includes the detection of a Global Positioning System ("GPS") signal from GPS satellites that allows a user or system operator to track the geographic position of the phone. Many wireless communication devices, such as handheld mobile phones, however, have antenna reception patterns that prevent reliable performance of features dependant on communication with a satellite.

BRIEF DESCRIPTION OF THE DRAWINGS

The above needs are at least partially met through provision of the wireless communication device antenna for communication with a satellite described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Generally speaking, pursuant to these various embodiments, a wireless communication device includes a mobile wireless communication signal creation and reception circuit coupled to a resonator, wherein the resonator is capable of radiating electromagnetic energy. The resonator is typically an antenna component, even though some other lumped reactive elements are sometimes coupled to the antenna component to produce an electromagnetic resonance or to widen the communication bandwidth (e.g., matching circuits). A parasitic element is coupled to the resonator in an approximately orthogonal arrangement such that the resonator and parasitic element resonate together to send and receive wireless communication signals.

So configured, the resonator and parasitic element create an antenna pattern with an enhanced upper lobe. The enhanced upper lobe provides improved coverage for sending and receiving signals from satellites. Thus, system or unit features that depend on reception between a wireless communication device and a satellite, such as GPS dependant features, are more reliable.

Figure 1:
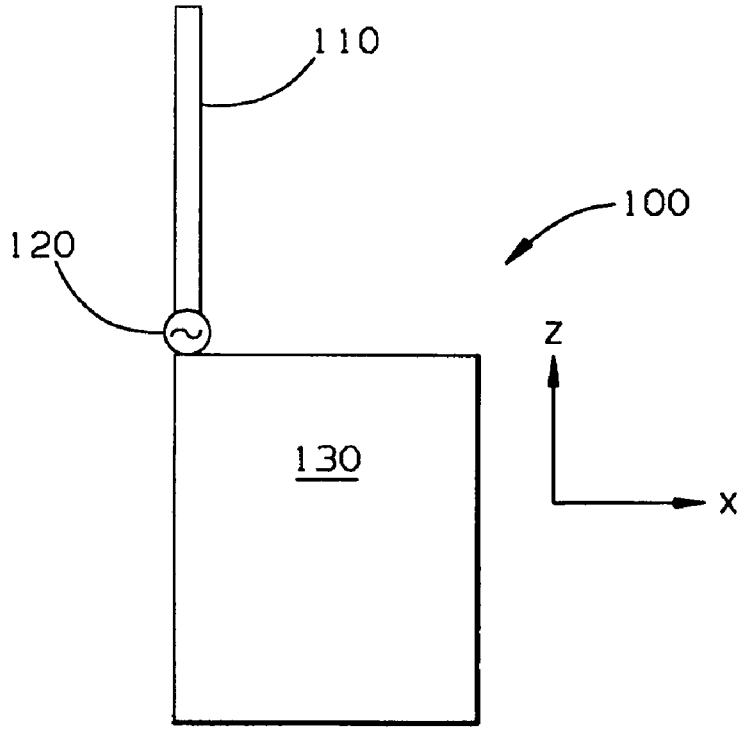
FIG. 1 (PRIOR ART)
FIG. 1 is a plan view of a prior art antenna system.

Referring now to the drawings, and in particular to FIG. 1, an antenna system 100 used in prior wireless communication devices will be described. The prior antenna system 100 includes a main antenna 110 coupled through an antenna feedpoint 120 to a ground plane 130. Axes x and z are drawn to establish a reference frame. The prior antenna system 100 is a basic system used in wireless communication devices such as handsets for mobile phones.

Figure 2:
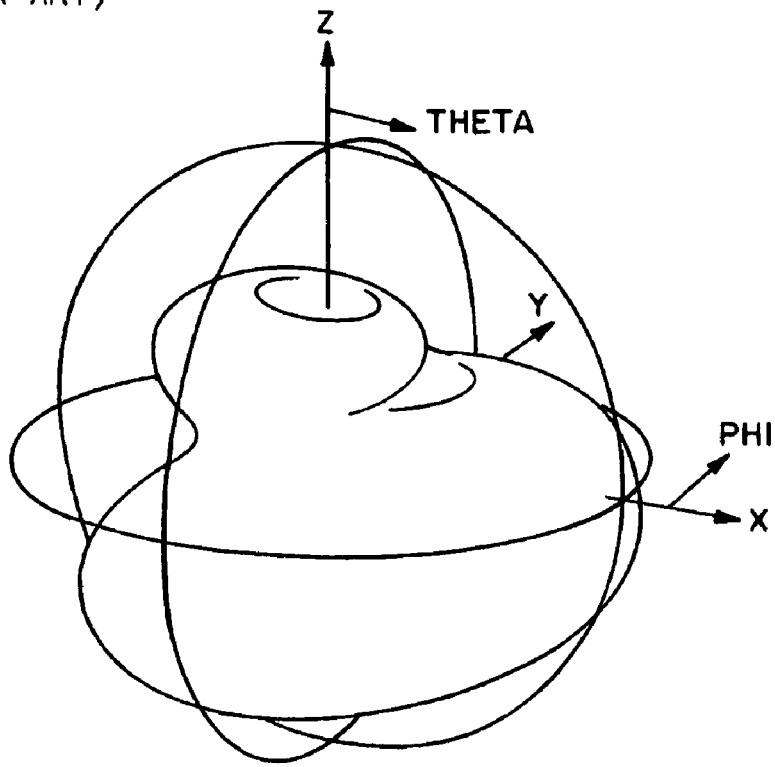
FIG. 2 (PRIOR ART)
FIG. 2 is a representation of the antenna pattern for the prior art antenna system of FIG. 1.

A representation of the antenna pattern for the prior art antenna system 100 is shown in FIG. 2. The antenna pattern demonstrates a null in the upper hemisphere of the pattern, designated in the positive z-axis, with the main lobe directed laterally and downward, designated along the x-axis and y-axis and in the negative z-axis respectively. Although such a pattern is sufficient for wireless communication devices in communication with ground based base stations, this pattern may frequently provide inadequate and unreliable coverage for communication with space-based transceivers or satellites.

An antenna system 300 according to various embodiments of the invention will be described with reference to FIG. 3. Axes x and z are drawn to establish a reference frame. The antenna system 300 includes a mobile wireless communication signal creation and reception circuit 310. The circuit 310 includes known structure enabling the device to receive and/or send signals. Such structure may include one or more processors, memory devices, software, or other supporting circuitry.

The circuit 310 is coupled to a resonator 320 through a transmission line 330, via a feedpoint 360. The resonator 320 is capable of radiating electromagnetic energy sufficient to send and receive wireless communication signals. One skilled in the art will recognize that the resonator 320 can be in the form of a single bar antenna or other structure capable of sending and/or receiving wireless communication signals. For example, such resonators 320 may include helix or double helix designs, monopole designs, designs with extendable main arms, or other suitable designs.

Figure 3:
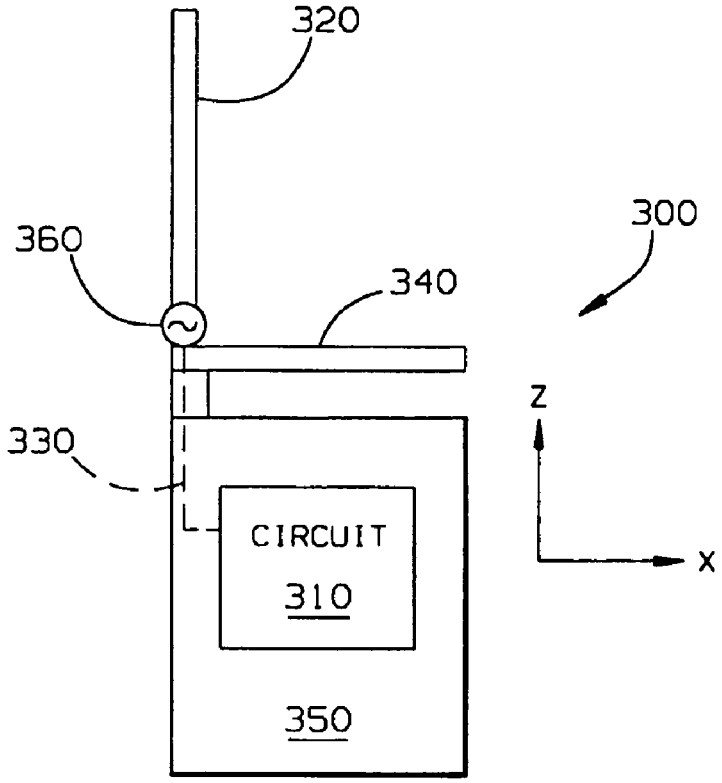
FIG. 3 is a plan view of an antenna system as configured in accordance with various embodiments of the invention.

With continuing reference to FIG. 3, a parasitic element 340 is coupled to the resonator 320 in approximately an orthogonal arrangement such that the parasitic element 340 and the resonator 320 resonate together to send and/or receive wireless communication signals. As known in the art, a parasitic element 340 is not actively driven by the wireless communication signal creation and reception circuit 310 but, instead, passively couples to the resonator 320 and a ground plane 350 to substantially reduce the radio frequency ("RF") current flowing in the ground plane 350. In other words, the parasitic element 340 may be a secondary resonator or conductor that resonates with the main resonator 320. The orthogonal relationship between the resonator 320 and the parasitic element 340 approximates what is known in the art as a V-shaped dipole. One skilled in the art will recognize that a V-shaped dipole creates an omni-directional radiation pattern substantially without nulls (portions of the antenna pattern with small reception).

Figure 4:
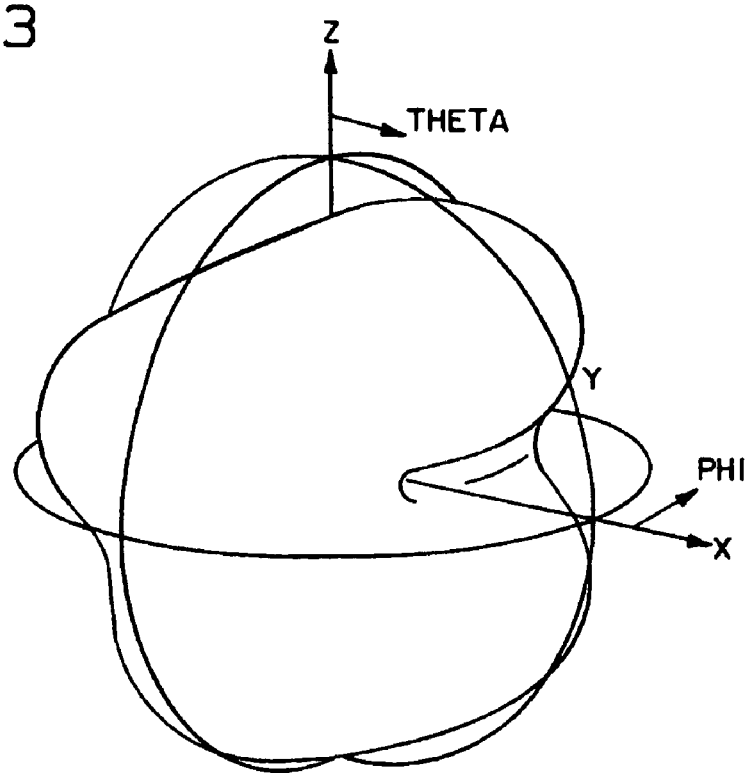
FIG. 4 is a representation of the antenna pattern for the antenna system of FIG. 3.

A representation of the antenna pattern created by the resonator 320 with a parasitic element 340 is illustrated in FIG. 4. Through the addition of the parasitic element 340 in an approximately orthogonal relationship to the resonator 320, reception in the upper lobe of the antenna pattern, designated in the positive z-axis, improves significantly. The approximately V-shaped dipole created by the arrangement of the resonator 320 and the parasitic element 340 creates this improvement by forming a more omni-directional radiation pattern and helping to eliminate nulls in the upper lobe of the antenna pattern when the antenna system 300 is in a vertical position.

With continuing reference to FIG. 3, the antenna system 300 includes a ground plane 350 coupled to the resonator 320 through an antenna feedpoint 360. In a preferred embodiment, the resonator 320 includes an arm extending from the ground plane 350 such that the ground plane 350 and the resonator 320 are approximately parallel. The arm can be any significant portion of the antenna design that extends away from the antenna feedpoint 360. Preferably, the parasitic element 340 also is parallel to the ground plane 350. In such an embodiment, the parasitic element 340 lies adjacent to the ground plane 350 whereas the resonator 320 extends away from the ground plane 350. Further, the parasitic element 340 is coupled to the ground plane 350 near the antenna feedpoint 360 for the resonator 320. One skilled in the art will recognize that the physical dimensions of the resonator 320 and the parasitic element 340 may be adjusted such that they will resonate together creating the improved antenna pattern at the appropriate frequencies for receiving and/or sending wireless communication signals in a given system.

Figure 5:
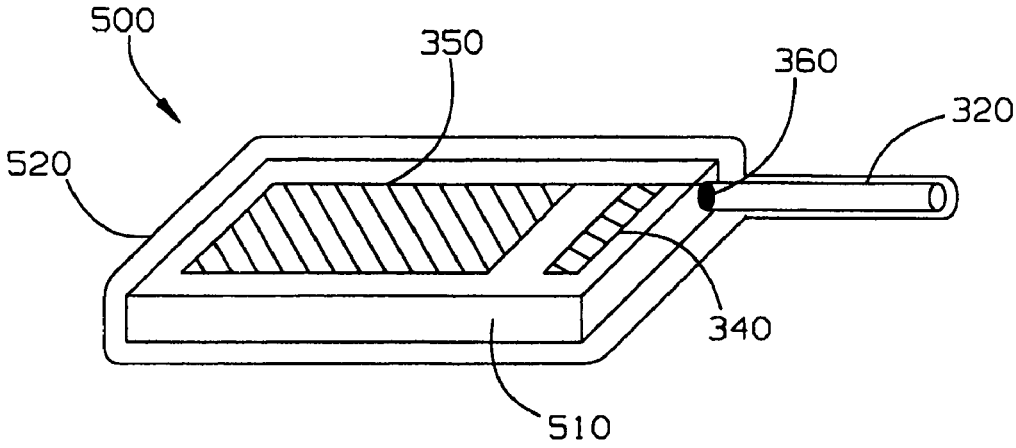
FIG. 5 is a perspective cutaway view of a handset as configured in accordance with various embodiments of the invention.

An alternative embodiment will be described with reference to FIG. 5. The antenna system 300 is disposed within a wireless communication handset 500. The handset 500 may be any handset for wireless communication devices such as a handset for a mobile phone. Such handsets are also known in the art as mobile stations. Preferably, the ground plane 350 includes a dielectric substrate board 510 disposed within the wireless communication handset housing 520. In such an embodiment, the ground plane 350 has a finite size relative to the resonator 320 and the parasitic element 340. The dielectric substrate board 510 is preferably integral with the wireless communication signal creation and reception circuit 310. In this embodiment, the parasitic element 340 may be printed on the dielectric substrate board 510 where the dielectric substrate board 510 is a printed circuit board.

Figure 6:
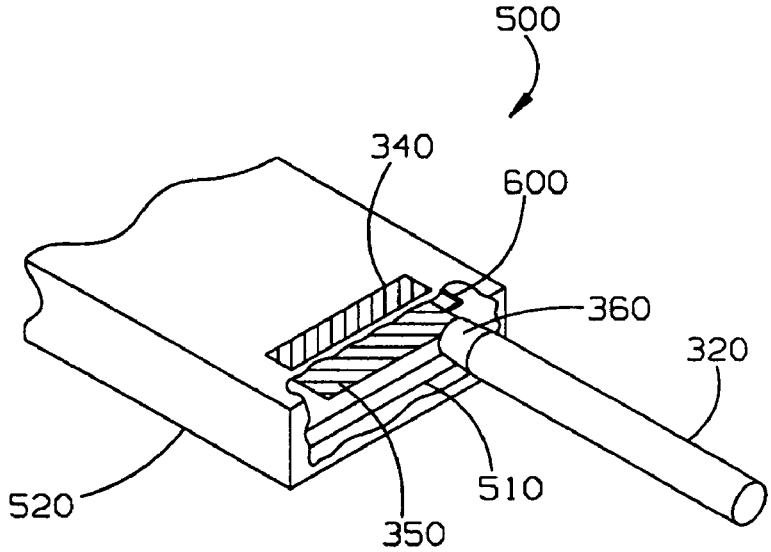
FIG. 6 a perspective cutaway view of a handset as configured in accordance with various embodiments of the invention.

In another alternative embodiment as illustrated in FIG. 6, the parasitic element 340 may be disposed on the housing 520 of the wireless communication handset 500. In such an embodiment, the parasitic element 340 may be lithographed or otherwise realized on the housing 520. Alternatively, the parasitic element 340 may be a separate element or conductor attached to the inside or outside of the housing 520 or contained within the housing 520. In each case, the parasitic element 340 may be coupled to ground plane 350, near feedpoint 360, through a wire or other conductor 600.

Figure 7:
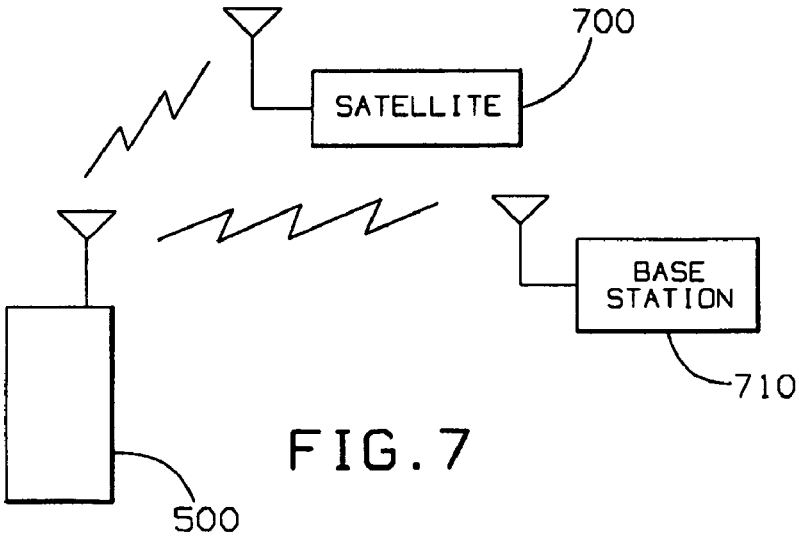
FIG. 7 is a block diagram as configured in accordance with various embodiments of the invention.

A use of the various embodiments will be described with reference to FIG. 7. A wireless communication device handset 500 that contains an antenna system 300 is in reliable wireless communication with a satellite 700 and a base station 710 because of the arrangement of the resonator 320 and the parasitic element 340. The signal received by the handset 500 from the satellite may be any type of signal such as multimedia data, a GPS signal, or other signal. For example, GPS satellites typically transmit GPS signals at a frequency of about 1.6 GHz. An antenna system 300 may be tuned by one skilled in the art to send and/or receive signals at 1.6 GHz especially for features using the GPS signal including, for example, mapping programs and the like.

Preferably, the antenna system 300 is configured to send and/or receive signals transmitted at one or more frequency ranges other than that specified for receiving signals from the satellite 700. In such an embodiment, the resonator 320 and the parasitic element 340 are tuned to resonate together at the frequency at which signals are sent to and/or received from a satellite 700. The resonator 320, however, may be further operable to send and receive signals at other frequencies such as for sending and receiving wireless communications as part of a ground-based system where the wireless communication device handset 500 communicates with a base station 710. Examples of such wireless communication systems include a Global System for Mobile ("GSM") communications system, a wireless Voice over Internet Protocol ("VoIP") system, a wireless Transmission Control Protocol/Internet Protocol ("TCP/IP") based system, a Code Division Multiple Access ("CDMA") system, a General Packet Radio Service ("GPRS") standard system, or the like. The resonator 320 may further send and receive signals at an additional frequency for analog communications. One skilled in the art will recognize that different configurations for a wireless communication creation and reception circuit 310 can handle multiple center frequencies of operation for a wireless communication device.

So configured, a wireless communication device may reliably send signals to and receive signals from a satellite. The approximately orthogonal arrangement between the resonator and the parasitic element create an improved upper lobe in the antenna pattern for the wireless communication device that enhances the reliability of communications with a satellite. With such enhanced communications, wireless communication device features such as GPS capabilities will be more readily accessible for users.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. An apparatus comprising:

a mobile wireless communication signal creation and reception circuit;

a resonator coupled to the mobile wireless communication signal creation and reception circuit wherein the resonator is capable of radiating electromagnetic energy;

a parasitic element coupled to the resonator in an approximately orthogonal arrangement such that the parasitic element and the resonator resonate together to send and receive a wireless communication signal; and a ground plane coupled to the resonator;

wherein the resonator and the parasitic element comprise an approximately V-shaped dipole.

2. The apparatus of claim 1 wherein the ground plane coupled to the resonator further comprises a dielectric substrate board and the ground plane is coupled to the parasitic element at approximately an antenna feedpoint for the resonator.

3. The apparatus of claim 2 wherein the dielectric substrate board is integral with the mobile wireless communication signal creation and reception circuit and is contained within a wireless communication handset.

4. The apparatus of claim 1 wherein the ground plane coupled to the resonator further comprises a finite size disposed within a housing enclosing the mobile wireless communication signal creation and reception circuit.

5. The apparatus of claim 1 wherein the resonator coupled to the mobile wireless communication signal creation and reception circuit further comprises an arm extending from and approximately parallel to the ground plane.

6. The apparatus of claim 5 wherein the parasitic element extends approximately adjacent and approximately parallel to the ground plane.

7. The apparatus of claim 6 wherein the parasitic element is printed on a printed circuit board.

8. The apparatus of claim 6 wherein the mobile wireless communication signal creation and reception circuit is contained within a wireless communication handset and the parasitic element further comprises a conductor on a housing of the wireless communication handset.

9. The apparatus of claim 1 wherein the wireless communication signal further comprises a signal sent from a satellite.

10. The apparatus of claim 9 wherein the wireless communication signal further comprises a global positioning system signal.

11. An apparatus comprising:

a mobile station handset including a housing;

a ground plane disposed within the housing;

a main antenna coupled to the ground plane; and a secondary resonator passively coupled approximately orthogonally to the main antenna, the secondary resonator having a length sufficient such that the secondary resonator and the main antenna resonate together at a frequency for receiving a signal from a satellite;

wherein the main antenna and the secondary resonator comprise an approximately V-shaped dipole.

12. The apparatus of claim 11 wherein the main antenna is further operable to send and receive wireless communications at least one frequency substantially different from the frequency for receiving the signal from the satellite.

13. The apparatus of claim 11 wherein the frequency for receiving the signal from the satellite is that of a global positioning system signal.

14. The apparatus of claim 11 wherein the secondary resonator is parasitically coupled to the main antenna adjacent to a feedpoint for the main antenna.

15. The apparatus of claim 11 wherein the secondary resonator is disposed on any one of:

the housing; or a printed circuit board disposed within the housing.

* * * * *